United States Patent [19]

Dockery

[11] Patent Number: 4,541,202

[45] Date of Patent: Sep. 17, 1985

[54] SLIDING DOOR OPERATOR AND LOCK

[76] Inventor: Daryl Dockery, P.O. Box 168, Hwy. 90 West, Ponce De Leon, Fla. 32455

[21] Appl. No.: 590,452

[22] Filed: Mar. 16, 1984

[51] Int. Cl.[4] ..... E05F 11/34

[52] U.S. Cl. ..... 49/362; 49/28; 49/139

[58] Field of Search ..... 49/362, 139, 28

[56] References Cited

U.S. PATENT DOCUMENTS

| | | | |
|---|---|---|---|
| 1,057,547 | 4/1913 | Heimer et al. . | |
| 1,063,328 | 6/1913 | Christopher | 49/362 X |
| 1,850,091 | 3/1932 | Bailey | 49/362 |
| 1,853,559 | 4/1932 | Halpin et al. | 49/362 |
| 2,065,431 | 12/1936 | Cotter | 20/52.2 |
| 2,345,594 | 4/1944 | Gardner | 49/362 |
| 3,469,345 | 9/1969 | Hanks | 49/362 X |
| 3,883,992 | 5/1975 | Bollinger, Sr. | 49/362 |
| 4,045,982 | 9/1977 | Gorton et al. | 70/90 |
| 4,050,189 | 9/1977 | Peterson | 49/139 X |
| 4,198,786 | 4/1980 | Monot | 49/362 |
| 4,366,649 | 1/1983 | Weigant | 49/362 |
| 4,366,670 | 1/1983 | Kitamura | 60/290 |

*Primary Examiner*—Philip C. Kannan

*Attorney, Agent, or Firm*—Gifford, VanOphem, Sheridan, Sprinkle & Nabonzy

[57] ABSTRACT

A sliding door operator comprises a tubular housing adapted to receive first and second elongated bars in a spaced apart and parallel arrangement. Both bars include a gear-toothed rack engaged by a single motor driven gear. An end of one bar is secured to the door and an end of the other bar is secured to a wall structure. A bracket secured to the door includes registering apertures adapted to mate with a bore in the end of one of the bars so that the bar can be detachably locked to the door by a locking pin. The other bar also includes a bore adapted to mate with the aperture in a channel bracket secured to the stationary wall structure to receive a removable locking pin therethrough. In addition, the operator includes a locking mechanism for locking the bars in a fixed position with respect to each other.

19 Claims, 8 Drawing Figures

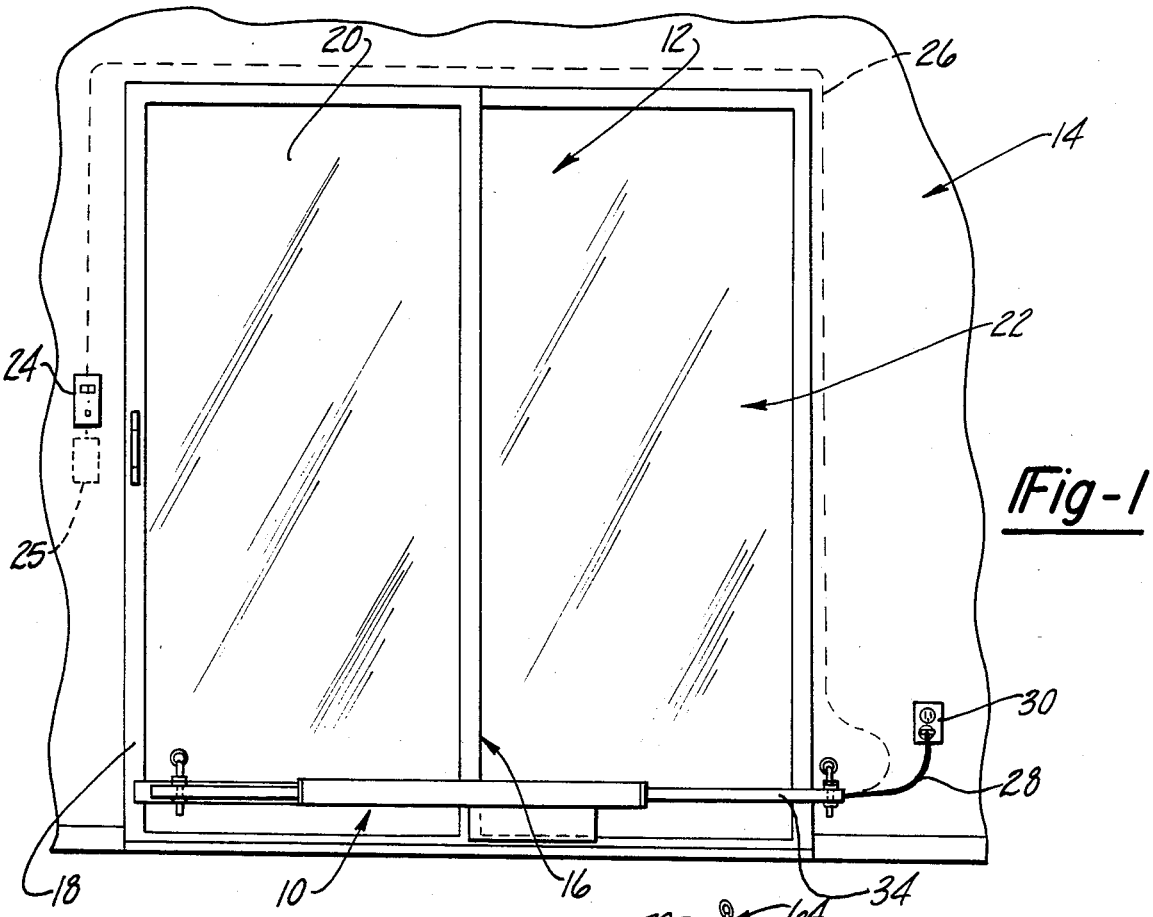
Fig-1
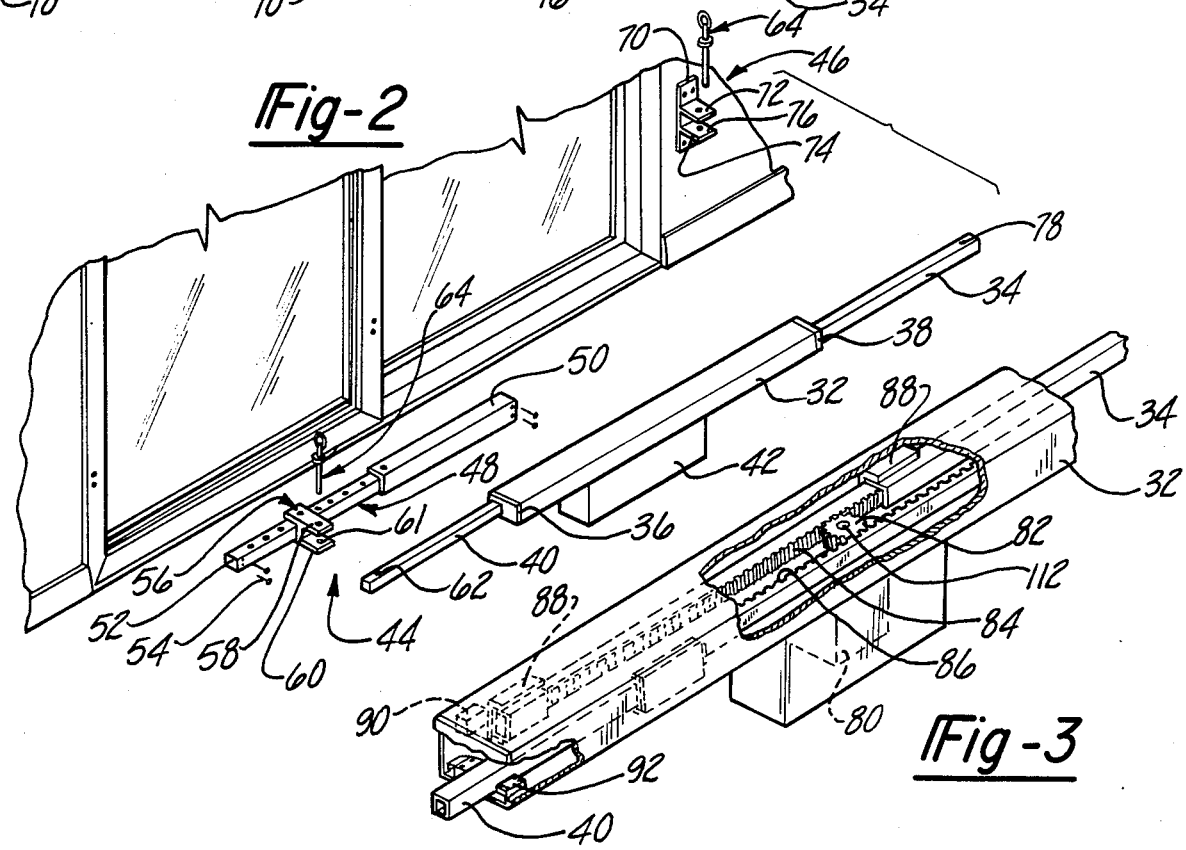
Fig-2
Fig-3

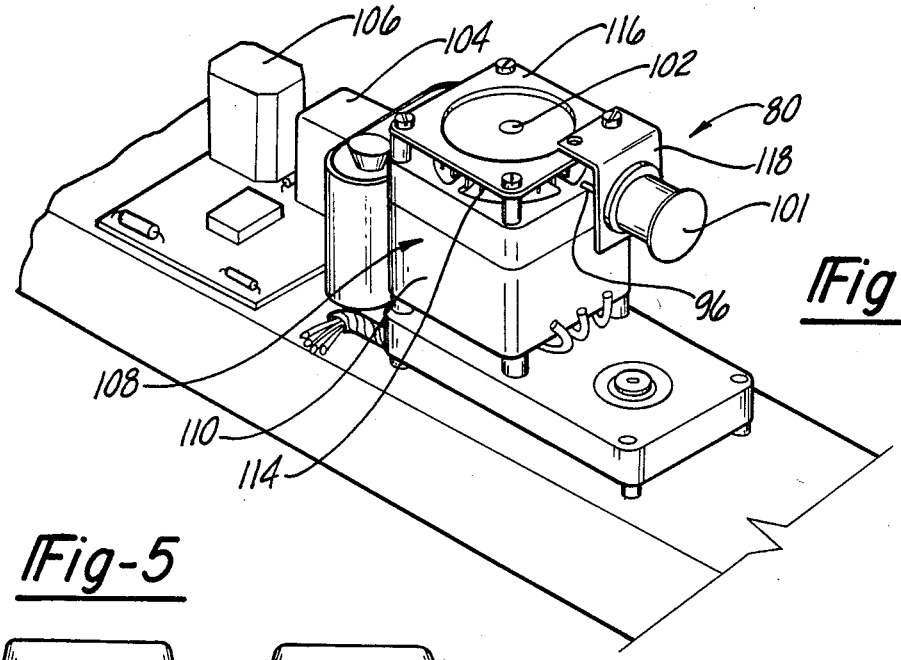
Fig-4
Fig-5
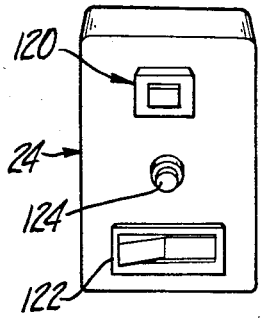
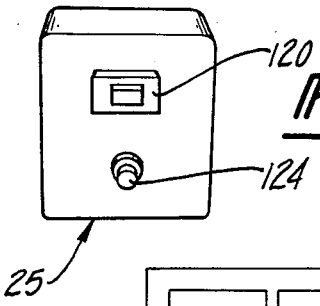
Fig-6
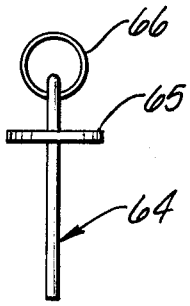
Fig-8
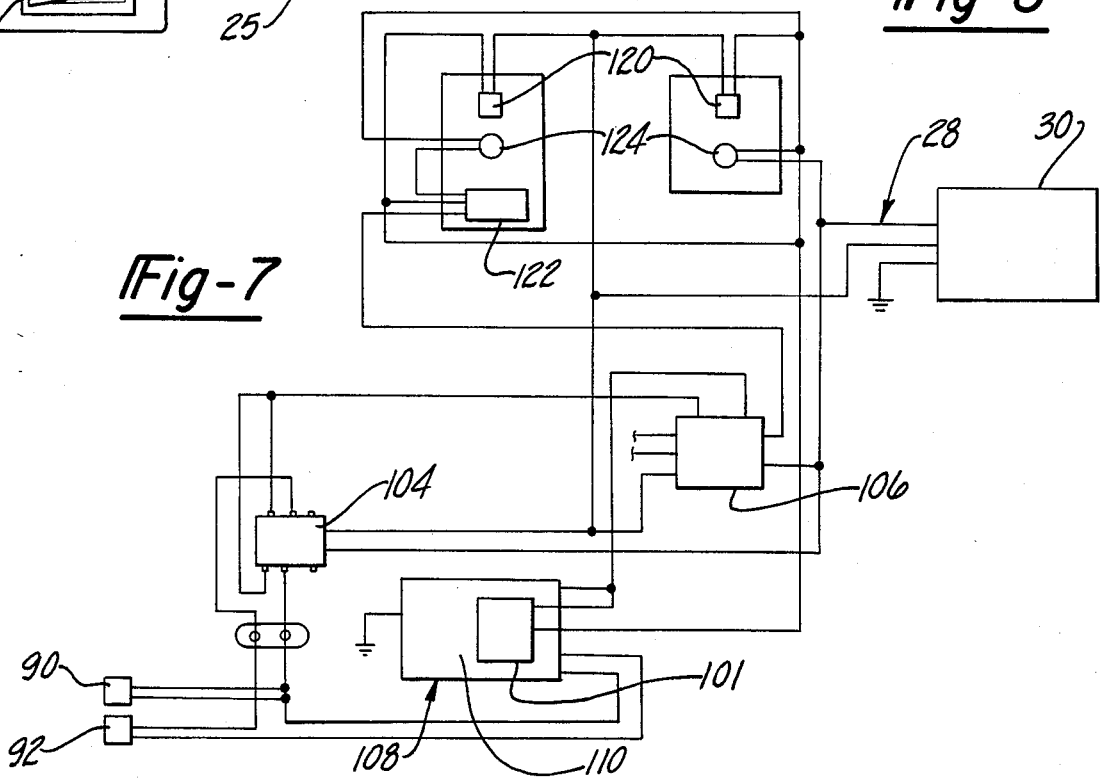
Fig-7

SLIDING DOOR OPERATOR AND LOCK

BACKGROUND OF THE INVENTION

1. Field of the Present Invention

The present invention relates generally to sliding door operators and more particularly to a door operator employing a motor driven gear which engages an elongated rack displaceable with respect to the supporting structure of the sliding door.

2. Description of the Prior Art

Sliding doors are a well known form of closure and various means have been employed for automatically operating the sliding doors. However, the operating mechanism for the sliding doors is often incorporated with the framing structure that supports the sliding door. For example, the bottom edge of the door can be provided with an elongated gear tooth rack which engages a rotatably driven gear supported in the door frame. Such an assembly is disadvantageous for the reason that repair of the door operating mechanism requires disassembly of the entire door structure, and thus substantially increases the complexity and cost of making repairs of the door operator.

It has also been known that a gear driven rack can be mounted on an exposed surface of the door. However, such a construction is disadvantageous for the reason that the appearance of a rack on the exposed portions of the door substantially detracts from the appearance of the door. Moreover, in order to open the door fully, the driven gear must be continuously rotated until the entire rack has been traversed by the gear. Accordingly, energy must be supplied to the gear driving means during the same period of time. As a result, if the door is wide, a substantial amount of energy may be necessary to fully open or fully close the door.

In addition, many previously known door openers are not readily adapted for use with previously installed sliding doors. This problem is especially true of sliding glass doors, commonly known as patio doors, especially since such doors slide in tracks which are often integrally constructed with the building structure. Accordingly, previously known operating mechanisms cannot be readily secured to previously installed patio doors without substantial reconstruction of the mounting track and surrounding structure.

SUMMARY OF THE PRESENT INVENTION

The present invention overcomes the above-mentioned disadvantages by providing a sliding door opening apparatus which is easily attached to existing sliding door structures, and which includes a pair of elongated members driven in opposite directions by a single rotating gear. In general, a housing containing a motor drive mechanism is adapted to slidably receive a pair of elongated bars, the free end of one bar being attached to the sliding door while the free end of the other bar member is attached to a stationary structure adjacent the door. A remote control switch activates the motor in the housing. Moreover, one of the elongated bars is detachably secured to the stationary support structure. Thus, when one of the elongated bars is detached, the door can be manually operated without affecting the control means used to operate the motor driven gear. Thus, an internal control mechanism can be used to lock the elongated bars in their extended or retracted positions and prevent manual displacement of the door when the elongated bars are attached to the door and the stationary support structure, respectively.

In the preferred embodiment of the present invention, the remote control comprises an internal switch box mounted within the building and having a master switch, and an external switch box which can activate the opener only when the master switch is activated. In addition, the internal control mechanism comprises limit switches in registration with the ends of the elongated bars at predetermined positions. The limit switches control the actuation of a means for locking the motor armature in position. Thus, for example, in fully closed position, the parallel bars are locked in position within the housing to form a rigid structure which cannot be manually forced open. Moreover, the control mechanism preferably includes a current monitor which senses excessive current draw when movement of the door is obstructed, and includes means for reversing the direction of the door movement in response to the detection of the obstruction.

In addition, in the preferred embodiment, the free ends of the elongated bars include bores adapted to receive a locking pin therethrough, while appropriate structures on the sliding door and the stationary support structure include apertures adapted to register with the bores in the ends of the elongated arms, and likewise receive the locking pin therethough. Preferably, the mounting means comprises a bracket defining a channel which slidably receives the free end of a bar therein so that the bar is slidable through the channel when the locking pin has been removed from the registering bores and apertures. In addition, in the preferred embodiment, one bracket is mounted to a telescopic bar member which can be extended or retracted so that it can be attached to a door of any width.

Thus, the present invention provides a sliding door operating mechanism which operates more efficiently than previously known door lock mechanisms, and which securely locks the door in its fully opened and fully closed positions. Moreover, all the working parts are enclosed within the housing, and the exposed parts can be provided with a smooth or attractive finished appearance, so that the device does not substantially detract from the appearance of the existing building structure. In addition, the device is easily secured to existing door structures, and does not require reworking of the door or the track of the framing structure of the door. Nevertheless, the device of the present invention permits both manual and automatic operation of the sliding door. Moreover, while the door can always be operated from the interior of the building, unauthorized or forced operation from the interior of the building can be prevented. These and other advantages of the present invention will be described in greater detail in the description of the preferred embodiment of the present invention.

BRIEF DESCRIPTION OF THE DRAWINGS

The present invention will be better understood by reference to the following detailed description of the preferred embodiment, when read in conjunction with the accompanying drawings in which like reference characters refer to like parts throughout the views and in which:

FIG. 1 is a front view of the door operator assembly according to the present invention;

FIG. 2 is an exploded, fragmentary, perspective view of the device shown in FIG. 1;

FIG. 3 is a broken perspective view of a portion of the device shown in FIGS. 1 and 2;

FIG. 4 is an enlarged perspective view of the internal structure of a portion of the housing shown in FIG. 3;

FIG. 5 is an enlarged perspective view of one remote control switch shown in FIG. 1;

FIG. 6 is an enlarged perspective view of another switch box shown in phantom line in FIG. 1;

FIG. 7 is a circuit diagram employed in the apparatus shown in FIG. 1; and

FIG. 8 is an enlarged side plan view of the locking pin shown in FIGS. 1 and 2.

DETAILED DESCRIPTION OF THE PREFERRED EMBODIMENT OF THE PRESENT INVENTION

Referring first to FIG. 1, a door operator 10 according to the present invention is thereshown secured to the door wall structure 12 in a building wall 14. The door wall structure 12 includes a sliding door panel 16 having a door frame 18 supporting a glass panel 20. The door 16 is slidable on a track adjacent to a fixed window panel 22. Of course, it is to be understood that the operator 10 can be used with other sliding door structures having one or more sliding panels, so long as at least one panel is slidable with respect to a stationary wall structure.

Operator 10 is electrically connected to a remote control switch box 24 by appropriate circuitry designated diagrammatically at 26. The switch box 24 is secured to the inside of the wall structure 14. An additional switch box 25 is secured on the exterior of the wall structure 14. In addition, electrical power cord 28 electrically connects an electric motor in the housing to a standard electrical outlet 30 in a manner to be described in greater detail hereinafter. Preferably, as shown in FIG. 1, wiring 26 and 28 extend through the hollow chamber of a tubular elongated member 34 so that the wiring is protectively housed within the bar and is hidden from view. The electrical circuitry will be described in greater detail hereinafter with respect to FIG. 7.

Referring now to FIG. 2, the operator 10 includes a tubular housing 32 closed at each end by end plates 36 and 38. Each of the end plates includes an aperture adapted to receive the end of one of the elongated bars 34 and 40 so that the bars 34 and 40 are aligned in a spaced and parallel arrangement as they extend outwardly from opposite ends of the tubular housing 32. The tubular housing 32 also includes a drive housing 42 which houses a means for driving the elongated bars 34 and 40 into and out of the housing 32.

A first connection means 44 secures the exposed end of the elongated bar 40 to the inside of sliding door 16 while a second connection means 46 secures the exposed end of the elongated bar 34 to the inside of stationary wall structure 14. As best shown in FIG. 2, the connection means 44 comprises a cross-bar 48 formed in two portions, a first tubular portion 50 which is adapted to slidably receive an elongated bar portion 52 so that the total length of the cross-bar 48 is adjustable. The free end of the bar 52 is secured to one side of the door frame 18 by appropriate fasteners such as the bolts 54, while the free end of the tubular member 50 is secured to the opposite side of the door frame 18 in a similar manner. The cross-bar 48 also supports a bracket 56 secured thereto. The bracket 56 has upper and lower flanges 58 and 60, respectively, defining a channel 61 adapted to receive the end of the elongated bar 40. The flanges 58 and 60 include registering apertures adapted to register with a bore 62 in the end of the elongated bar 40 so that the bar 40 can be secured to the cross-bar 48 by the locking pin 64. Preferably, the apertures in the flanges 58 and 60 and the bore 62 are vertically aligned so that locking pin 64 is retained in position to lock the members together as the enlarged shoulder 65 (FIG. 8) extends radially beyond the apertures. An extractor ring 66 (FIG. 8) extends through an aperture in the pin 64 to provide a handle for removal and insertion of pin 64.

Similarly, connection means 46 comprises a bracket 70 secured to the wall structure 14. The bracket 70 includes outwardly extending flanges 72 and 74 which define a channel 76 adapted to receive the elongated tubular bar 34. The flanges 72 and 74 include registering apertures adapted to register with the bore 78 in the end of the tubular bar 34 so that the bar 34 can be locked to the wall mounted bracket 70 by means of a second locking pin 64. As best shown in FIG. 1, the operator 10 can be conveniently positioned at any level above the floor surface up to the top of sliding door. Preferably, as shown in FIGS. 1–3, the operator 10 is positioned high enough so that the drive housing 42 depends below tubular housing 32 without engaging the floor, whereby the housing 42 does not extend outwardly from the door so as to cause an obstruction.

Referring now to FIG. 3, the means for driving the elongated bars 34 and 40 can be more particularly described. The drive housing 42 encloses a motor drive means 80 including an electric motor 108 whose shaft 112 is secured to an output gear 82. The gear 82 is disposed between and engages gear tooth racks 84 and 86 on the bars 34 and 40 respectively. Accordingly, rotation of the gear 82 simultaneously retracts or extends the elongated bars 34 and 40 in the tubular housing 32. In addition, the tubular housing 32 supports channel bar guides 88 (only two shown) to guide the bars 34 and 40 and maintain engagement with gear 82 as they slide in and out of the tubular housing 32.

Referring now to FIG. 4, the other end of the motor drive means 80 is more clearly shown and comprises motor housing 110 in which a rotor including motor shaft 112 is rotatably mounted. A finned portion 114 of the rotor extends outwardly from the housing 110 inside an end plate 116 on the end of the housing. A bracket 118 secured to the end plate 116 supports a solenoid 101 so that a solenoid pin 96 registers with the finned portion 114 of the rotor. As will be described in greater detail hereinafter the pin 96 is resiliently biased to extend between fins on the finned portion of the rotor 114 so as to lock the rotor in a fixed position. Thus, the gear 82 on shaft 112 and the elongated bars 34 and 40 are likewise locked in a fixed position. Thus, drive mechanism 80 of the present invention provides a means for locking the door in a predetermined position when it is desirable to prevent manual operation of the door, especially from the exterior of the building when the drive means is inoperative.

Referring now to FIG. 5, switch box 24 is thereshown comprising an activation switch 120 as well as a master control switch 122. In addition, the front panel of the switch box 24 includes an indicator light 124 to indicate when the electrical circuit is in an operating condition. Similarly, as shown in FIG. 6, switch box 25 includes an activation switch 120 and an indicator light 124.

As will be best understood by reference to FIG. 7, the master switch 122 on switch box 24 opens and closes a circuit for electrical power to the entire system. Unless the master switch 122 is turned to the "on" position so as to complete the circuit, the activation switches 120 will be inoperative to activate the motor 108 or solenoid 101. In such a case, the indicator light 124 is not lit. Conversely, when the master switch 122 is switched to its "on" position to close the circuit, activation switches 120 can be used to open or close the doors desired. Preferably, the switch box 24 is secured to the interior of the building so that the external switch box 25 can be made inoperative as desired by the occupants of the building.

As also shown in FIG. 7, the activation switches 120 are connected to the motor 108 through the latching relay 104 which controls the direction of rotation of the reversible motor 80. A first engagement of the push button for the activation switch 120 causes activation of motor 80 in a first direction, for example, retracting the elongated bars 34 and 40 so as to open the sliding door 16. A second activation of the switch button reverses the direction of the motor 108 and thus extends the elongated bars 34 and 40 so as to close the doors 16.

Referring again to FIG. 3, the drive means 80 in housing 32 comprises internal control means including limit switches 90 and 92. As shown, the limit switch 90 is adjacent the inner end of elongated bar 34 so that full retraction of the bar 34 into the housing 32 causes the bar to contact the switch 90 and deactivate the motor as well as solenoid 101. Accordingly, the switch is used to stop the motor and lock the gear 82 against rotation. Similarly, the switch 92 is positioned so that upon full extension of the bar 40 from the housing 32 the end of the bar 40 passes the lever arm of the switch and causes the switch to open the circuit to the motor 108 and solenoid 101. Accordingly, the switches are used to deactivate the motor circuit and deactivate the solenoid so that the spring-biased solenoid pin extends between fins in portion 114 which locks the motor armature 102 and thus, locking gear 82 in a fixed rotational position. Nevertheless, the switches can be mounted in any manner and variably positioned so long as they respond to the ends or other portions of the elongated bars as they slide in and out of the housing so that when the door 16 is fully closed it cannot be manually forced to slide since the elongated bars 34 and 40 are also locked in the fully retracted or extended position. On the other hand, it is to be understood that the remote control switches 24 and 25 overide the switches to directly control the drive motor 108 and solenoid 101.

As shown in FIGS. 4 and 7, the drive means 80 also includes a current monitor 106 which is connected to a latching relay 104. The current monitor 106 senses a current surge which occurs when rotation of the motor rotor is impeded as can occur when an object obstructs movement of the door 16 within the door frame 12. Upon detection of such a current surge, the latching relay is activated to reverse the rotation of the rotor 102 and thereby reverse the direction in which the door 16 is traveling. Such a feature is especially advantageous since it prevents injury to persons who might be passing through the doorway when the drive mechanism 80 has been activated.

Having thus described the important structural features of the preferred embodiment of the present invention, the use and operation of the device in accordance with the present invention is readily described. The cross-bar 48 is secured to the door frame 18. Since bar member 52 is slidably received in the tubular member 50, the cross-bar 48 is adaptable for use with a wide range of door widths. Stationary mounting bracket 70 is then secured at the same height from the floor surface on the stationary wall structure 14. The operating device 10 is then secured to the cross-bar 48 by resting elongated bar 40 in the channel 61 of the bracket 56 and placing the locking pin 64 through the registering apertures in the bracket and the bore 62 in the bar 40. The elongated bar 34 is then secured to the bracket 70 in a similar manner.

Once the master switch 122 is turned on, the drive means 80 is activated by the remote control means 24 or 25. The remote control means 24 or 25 overrides the switches 90 and 92 and connects the electrical power to the motor. The motor drives the gear wheel 82 so that the bars 34 and 40 are retracted into the housing 32. The position of the switch 90 is adjusted so that upon full opening of the door 16, the switch 90 is contacted by the end of the bar 34, whereby the drive means 80 is deactivated and locked in position. Further actuation of one of the remote controls 24 or 25 causes the drive means 80 to rotate the gear 82 in the opposite direction so that the bar members 34 and 40 are extended outwardly from the tubular housing 32. Upon full closure of the door panels 16, the limit switch 92 is positioned so that the end of the bar 40 passes and deactivates the switch 92. Accordingly, the locking pin 96 is extended outwardly from the solenoid 101 into the finned rotor portion 114. As a result, the bars 34 and 40 are locked in their fully extended position and cannot be manually forced into the housing 32, whereby the door is firmly locked shut. Moreover, it will be understood that the door cannot accidentally trap a person in the doorway during closing of the door since the automatic reversing means formed by the current monitor and latching relay automatically reverses the door movement when an obstruction is encountered.

In the event of a power failure, or other need for manually opening the door 16, the operator 10 is easily disconnected by removing one of the locking pins 64 from the ends of the operator 10. For example, the locking pin 64 can be removed from the elongated bar 34 so that the bar 34 is free to slide within the channel 76 in bracket 70. Since the operator is preferably mounted on the inside of the door wall structure 12, unauthorized manual operation of the door from outside the building is prevented.

Thus the present invention provides a sliding door operator which can be readily attached to previously installed sliding door structures. Moreover, the device operates more efficiently than previously known door operators for the reason that rotation of the drive gear causes simultaneous retraction or extension of two bar members. Thus, the drive means can be activated for substantially half of the time required for previously known gear driven mechanisms. Moreover, the device of the present invention provides means for rigidly locking the door in its closed position to prevent forced manual opening of the sliding door. Nevertheless, when manual operation is desired, locking pins are easily removed from one end of the operator so that the door can be freely slid open.

Having thus described my invention, many modifications thereto will become apparent to those skilled in the art to which it pertains without departing from the scope and spirit of the present invention as defined in the appended claims.

What is claimed is:

1. An apparatus for operating a sliding door in a stationary structure;

a first elongated bar having a first elongated gear-toothed rack;

a second elongated bar having a second elongated gear-toothed rack;

a housing adapted to slidably receive said first and second racks in a spaced, parallel arrangement;

a pinion gear, and first means for rotatably supporting said gear in said housing intermediate said first and second racks so that said gear engages said first and second elongated gear-toothed racks;

second means for selectively, rotatably driving said gear;

third means for securing said first elongated bar to the door, and;

fourth means for securing said second elongated bar to the stationary structure.

2. The invention as defined in claim 1 wherein said third means comprises means for detachably locking said first bar to said door.

3. The invention as defined in claim 2 wherein said third means further comprises means for slidably supporting said first bar at a fixed vertical position.

4. The invention as defined in claim 1 wherein said fourth means comprises means for detachably securing said second bar to said stationary structure.

5. The invention as defined in claim 4 wherein said fourth means further comprises means for slidably supporting said second bar at a fixed vertical position.

6. The invention as defined in claim 1 wherein said second means comprises an electric motor and means for selectively actuating said motor.

7. The invention as defined in claim 1 wherein said fourth means comprises a bore in said second elongated bar, a bracket secured to said stationary structure having at least one flange with an aperture adapted to register with said bore in said second bar, and a locking pin slidably inserted in said registering bore and aperture.

8. The invention as defined in claim 7 wherein said bore is vertically aligned and wherein said pin includes an enlarged head portion.

9. The invention as defined in claim 1 wherein said door includes a perimetric door frame, and wherein said third means comprises a cross-bar secured at opposite ends to opposite sides of said door frame, whereby said cross-bar extends across the opening in said frame.

10. The invention as defined in claim 9 wherein said cross-bar comprises a tubular member and a rigid member adapted to be telescopically received in said tubular member.

11. The invention as defined in claim 10 wherein said third means further comprises fifth means defining at least one locking aperture adapted to receive a locking pin therethrough for locking said first elongated bar to said cross-bar, a locking pin, and a bore in said first elongated bar adapted to register with said locking aperture.

12. The invention as defined in claim 11 wherein said fifth means comprises a bracket secured to said cross-bar, said bracket having at least one flange extending outwardly from said cross-bar.

13. The invention as defined in claim 12 wherein said bracket defines a channel adapted to slidably receive said first elongated bar.

14. The invention as defined in claim 1 wherein at least one of said third means and said fourth means comprises a bracket defining a channel adapted to slidably receive and support its respective elongated bar;

and means for detachably securing said respective elongated bar to said bracket.

15. The invention as defined in claim 1 and further comprising means for locking said first and second elongated bars into position with respect to each other.

16. The invention as defined in claim 15 wherein said means for locking comprises means responsive to the position of an end of at least one of said first and second elongated bars for activating said locking means.

17. The invention as defined in claim 1 wherein said second means comprises an electrical motor and switch means for activating said motor.

18. The invention as defined in claim 17 wherein said switch means comprises a first remote control switch and a second remote control switch secured to opposite sides of said stationary structure.

19. The invention as defined in claim 17 wherein said switch means comprises means for sensing an obstruction during movement of said door and means responsive to said means for sensing and for automatically reversing the movement of said door upon detection of an obstruction.

* * * * *